US010518280B2

(12) United States Patent
Scott et al.

(10) Patent No.: US 10,518,280 B2
(45) Date of Patent: Dec. 31, 2019

(54) SELF SEALING AND CLEANING NOZZLE

(71) Applicants: Michael Scott, San Francisco, CA (US); Huankun Lao, Shangyu (CN)

(72) Inventors: Michael Scott, San Francisco, CA (US); Huankun Lao, Shangyu (CN)

(73) Assignee: ST&T INTERNATIONAL, INC., Zephyr Cove, NV (US)

( * ) Notice: Subject to any disclaimer, the term of this patent is extended or adjusted under 35 U.S.C. 154(b) by 0 days.

(21) Appl. No.: 15/138,632

(22) Filed: Apr. 26, 2016

(65) Prior Publication Data

US 2017/0304847 A1 Oct. 26, 2017

(51) Int. Cl.

| | |
|---|---|
| ***B05B 11/00*** | (2006.01) |
| *B05B 1/30* | (2006.01) |
| *B05B 15/522* | (2018.01) |
| *B05B 15/50* | (2018.01) |
| *B05B 1/32* | (2006.01) |

(52) U.S. Cl.

CPC ..... *B05B 11/0064* (2013.01); *B05B 1/304* (2013.01); *B05B 1/3033* (2013.01); *B05B 1/32* (2013.01); *B05B 11/3025* (2013.01); *B05B 11/3069* (2013.01); *B05B 15/50* (2018.02); *B05B 15/5225* (2018.02)

(58) Field of Classification Search

CPC ..... B05B 1/3033; B05B 1/304; B05B 1/3046; B05B 1/306; B05B 1/3073; B05B 1/32; B05B 1/323; B05B 11/3025; B05B 11/3069; B05B 11/0064; B05B 15/50; B05B 15/5225

USPC ..... 239/114–117, 451–143, 456, 459

See application file for complete search history.

(56) References Cited

U.S. PATENT DOCUMENTS 713,852 A * 11/1902 Chapin ..... B05B 15/5225 239/117
2,803,499 A * 8/1957 Goyette ..... D21F 1/32 239/109
3,059,857 A * 10/1962 Friant ..... B05B 15/70 239/117
3,284,608 A * 11/1966 McDonald ..... B23K 9/32 219/137.43
3,780,951 A * 12/1973 Powers ..... B05B 11/3011 239/333

(Continued)

*Primary Examiner* — Steven J Ganey
*Assistant Examiner* — Joseph A Greenlund
(74) *Attorney, Agent, or Firm* — Polsinelli PC

(57) ABSTRACT

In one embodiment, a self-cleaning nozzle comprises a nozzle body, a sleeve surrounding a proximal end of the nozzle body, a pillar disposed within the nozzle body and a spring. The nozzle body may have a hollow cylindrical interior. The nozzle body may include an orifice formed in a distal end of the nozzle body, a shoulder formed on a proximal end of the nozzle body, and a first bearing surface on an outer lateral face of the shoulder. The sleeve may include a second bearing surface on an inner face of the sleeve and a retaining lip formed at a distal end of the sleeve. The retaining lip may define a distal end of an annular space between the sleeve and the nozzle body. The shoulder may define a proximal end of the annular space. The pillar may have a distal tip configured to interface with the orifice, thereby forming a liquid seal. The spring may be captured within the annular space, thereby biasing the distal tip of the pillar into contact with the orifice.

12 Claims, 5 Drawing Sheets

(56) References Cited

U.S. PATENT DOCUMENTS

| | | | | | |
|---|---|---|---|---|---|
| 4,223,838 | A * | 9/1980 | Maria-Vittorio-Torrisi | A01G 25/023 | 239/109 |
| 4,350,301 | A * | 9/1982 | Erwin | F02M 61/08 | 239/453 |
| 4,396,044 | A * | 8/1983 | Ahlers | B67C 3/002 | 134/104.2 |
| 4,480,789 | A * | 11/1984 | Kemper | B05B 1/3006 | 239/116 |
| 4,519,527 | A * | 5/1985 | Klaeger | B05B 11/00442 | 222/383.1 |
| 4,941,614 | A * | 7/1990 | Ilott | B05B 1/3046 | 239/294 |
| 5,119,991 | A * | 6/1992 | Divers | B05B 15/5225 | 239/117 |
| 5,765,752 | A * | 6/1998 | Herr | B05B 1/3006 | 239/117 |
| 5,823,435 | A * | 10/1998 | Morgan | B05B 1/323 | 239/107 |
| 5,927,329 | A * | 7/1999 | Yie | A62C 31/02 | 137/624.13 |
| 6,345,774 | B1 * | 2/2002 | Calhoun | B05B 11/3057 | 222/383.1 |
| 6,481,644 | B1 * | 11/2002 | Olsen | A62C 31/03 | 239/456 |
| 7,124,964 | B2 * | 10/2006 | Bui | A01G 25/023 | 239/519 |
| 8,672,678 | B2 * | 3/2014 | Gramann | A61C 3/025 | 433/88 |
| 9,770,803 | B2 * | 9/2017 | Kakumu | B05B 15/5223 | |
| 2014/0319245 | A1 * | 10/2014 | Kelly | B05B 11/3042 | 239/375 |

* cited by examiner

SELF SEALING AND CLEANING NOZZLE

BACKGROUND

The present disclosure relates generally to dispensing nozzles. In particular, self-cleaning dispensing nozzles are described.

Known dispensing nozzles are not entirely satisfactory for the range of applications in which they are employed. For example, existing dispensing nozzles may be prone to an undesirable build-up of product near the dispensing tip of the nozzle. In addition, conventional dispensing nozzles allow for evaporation and oxidation of the product they dispense.

Thus, there exists a need for dispensing nozzles that improve upon and advance the design of known dispensing nozzles. Examples of new and useful dispensing nozzles relevant to the needs existing in the field are discussed below.

SUMMARY

In one embodiment, a self-cleaning nozzle comprises a nozzle body, a sleeve surrounding a proximal end of the nozzle body, a pillar disposed within the nozzle body and a spring. The nozzle body may have a hollow cylindrical interior. The nozzle body may include an orifice formed in a distal end of the nozzle body, a shoulder formed on a proximal end of the nozzle body, and a first bearing surface on an outer lateral face of the shoulder. The sleeve may include a second bearing surface on an inner face of the sleeve and a retaining lip formed at a distal end of the sleeve. The retaining lip may define a distal end of an annular space between the sleeve and the nozzle body. The shoulder may define a proximal end of the annular space. The pillar may have a distal tip configured to interface with the orifice, thereby forming a liquid seal. The spring may be captured within the annular space, thereby biasing the distal tip of the pillar into contact with the orifice.

DETAILED DESCRIPTION

Figure 1:
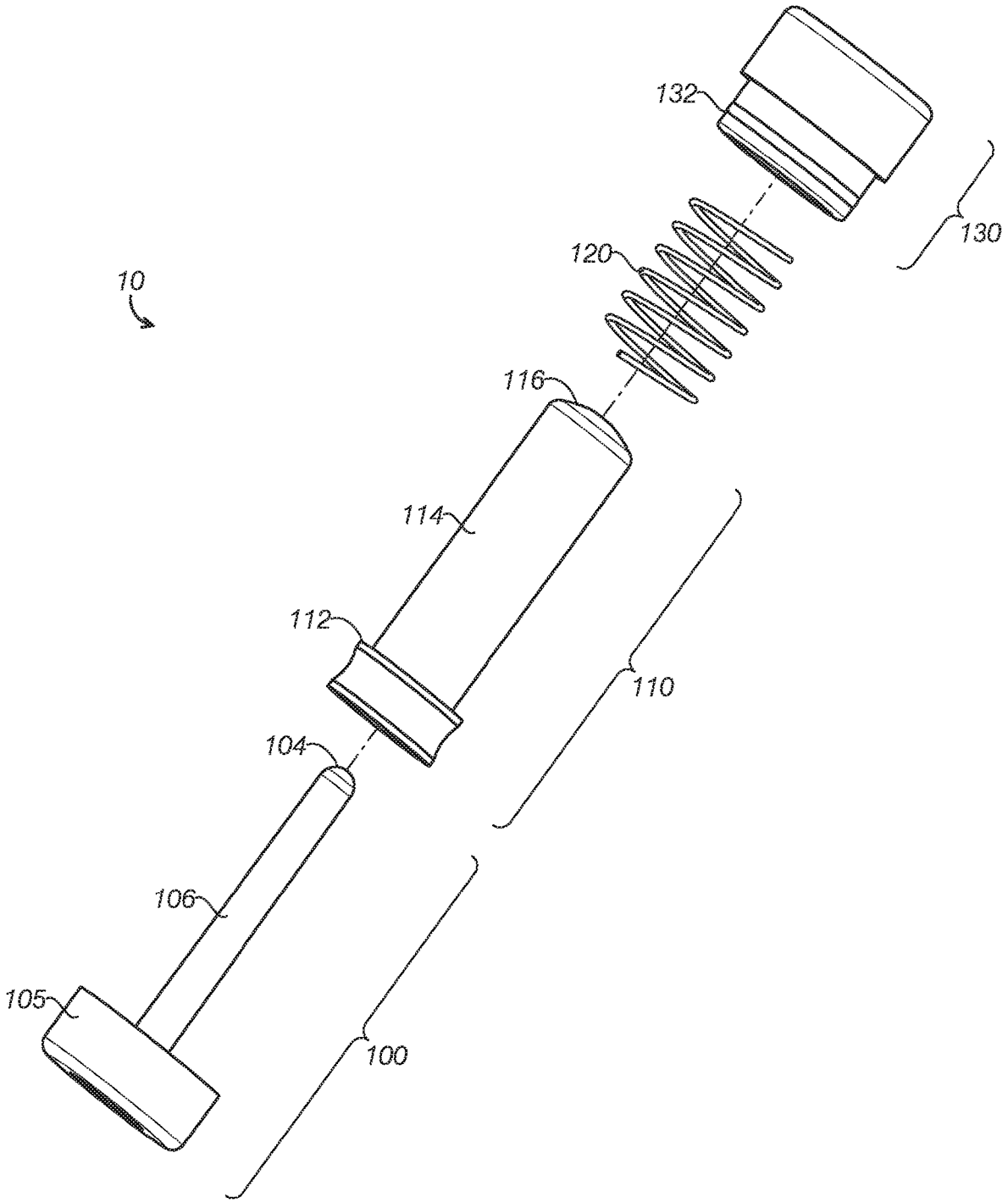
FIG. 1 is an exploded view of a first embodiment of a self-cleaning nozzle.

The disclosed self-cleaning nozzles will become better understood through review of the following detailed description in conjunction with the figures. The detailed description and figures provide merely examples of the various inventions described herein. Those skilled in the art will understand that the disclosed examples may be varied, modified, and altered without departing from the scope of the inventions described herein. Many variations are contemplated for different applications and design considerations; however, for the sake of brevity, each and every contemplated variation is not individually described in the following detailed description.

Throughout the following detailed description, examples of various self-cleaning nozzles are provided. Related features in the examples may be identical, similar, or dissimilar in different examples. For the sake of brevity, related features will not be redundantly explained in each example. Instead, the use of related feature names will cue the reader that the feature with a related feature name may be similar to the related feature in an example explained previously. Features specific to a given example will be described in that particular example. The reader should understand that a given feature need not be the same or similar to the specific portrayal of a related feature in any given figure or example.

With reference to FIGS. 1-5, a first example of a self-cleaning nozzle, nozzle 10, will now be described. Nozzle 10 functions to dispense liquid and seal itself. The reader will appreciate from the figures and description below that nozzle 10 addresses shortcomings of conventional dispensing nozzles.

For example, as it dispenses product, nozzle 10 functions to prevent build-up of dried product near the dispensing tip. Furthermore, in addition to the being self-cleaning, nozzle 10 may also be self-sealing. Thus, nozzle 10 may prevent evaporation and/or oxidation of the product.

Nozzle 10 includes a nozzle body 110, a sleeve 130 surrounding a proximal end of the nozzle body 110, a pillar 106 disposed within the nozzle body 110 and a spring 120.

Turning now to FIG. 1, an exploded view of nozzle 10 is shown. As can be seen in FIG. 1, nozzle body 110 may comprise a hollow cylinder 114, a shoulder 113 formed on a proximal end of the nozzle body 110, and a dispensing end 116 formed on a distal tip of the nozzle body 110. Shoulder 113 has a larger diameter than hollow cylinder 114. A first bearing surface 111 may be disposed on an outer lateral face of shoulder 113.

As described below, first bearing surface 111 may interface with a second bearing surface 136 on the interior of sleeve 130 to form a first liquid seal. A third bearing surface 112 may be disposed on the outer lateral face of shoulder 113. As described below, third bearing surface 112 may interface with second bearing surface 136 to form a second liquid seal.

Still referring to FIG. 1, spring 120 may be configured to slide over hollow cylinder 114 and engage shoulder 113. Sleeve 130 may then be slid over hollow cylinder 114 until it surrounds the proximal end of the nozzle body 110, including shoulder 113 and spring 120.

As can be seen, pillar 106 may be supported via a pillar assembly 100. Pillar assembly 100 may include pillar 106 and a sleeve cap 105. Pillar 106 may have a distal tip 104. The proximal end of pillar 106 may be attached to sleeve cap 105.

Figure 2A:
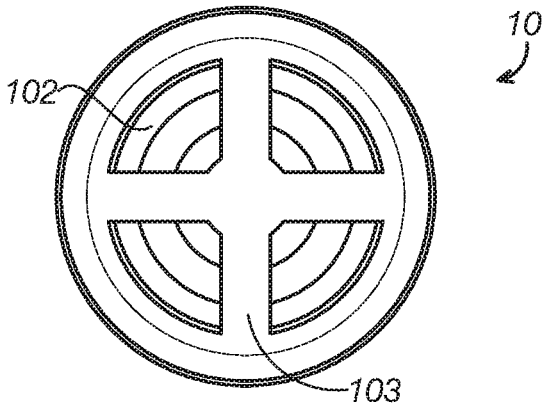
FIG. 2A is an elevation view of the proximal end of nozzle of FIG. 1.

Turning now to FIG. 2A, an elevation view of the proximal end of the nozzle 10 is shown. As can be seen, the rear face of end cap 105 includes pillar supports 103 separated by perforations 102. Pillar supports 103 function to secure the base of pillar 106 to end cap 105. As described below, perforations 102 function to allow liquid product to enter into the proximal end nozzle 10. In the illustrated embodiment, perforations 102 are generally triangular in shape. In other embodiments, the perforations may be of any other suitable shape and size to allow liquid product to pass through.

Figure 2B:
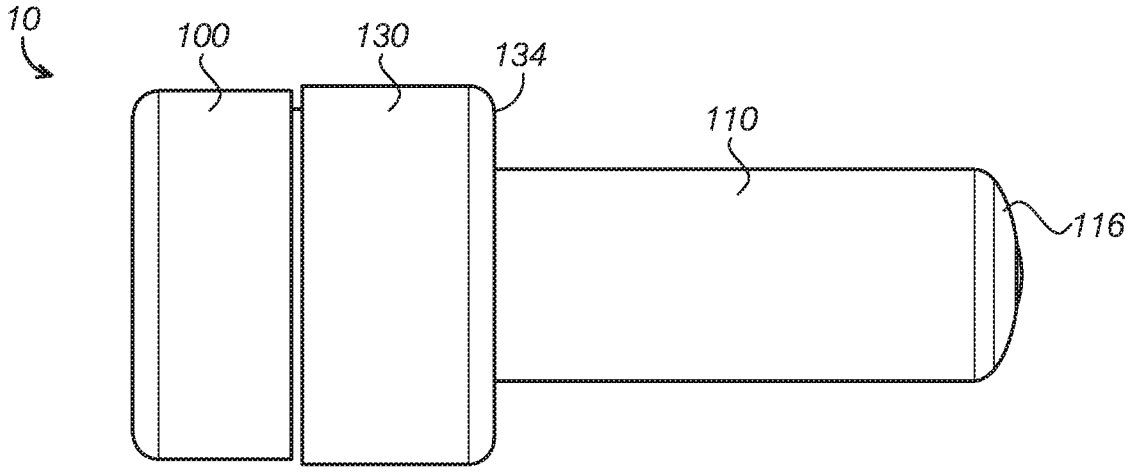
FIG. 2B is a side elevation view of the nozzle of FIG. 1.

As can be seen in FIG. 2B, end cap 105 and sleeve 130 mate together to form a housing over the proximal end of the nozzle body 110. In this regard, referring back to FIG. 1, sleeve 130 may include sealing ring 132. Sealing ring 132 may compress against the inner surface of end cap 105, thereby forming a third liquid seal.

Figure 2C:
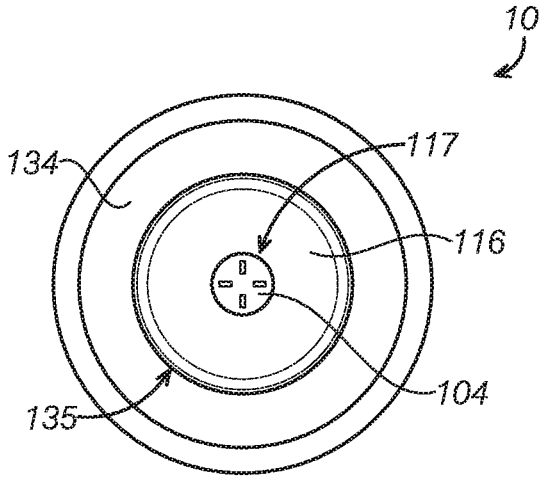
FIG. 2C is an elevation view of the distal end of the nozzle of FIG. 1.

FIG. 2C shows an elevation view of the distal end of nozzle 10. As can be seen, dispensing end 116 includes an orifice 117. The distal tip 104 of pillar 106 may interface with orifice 117 to form fourth liquid seal.

Figure 3:
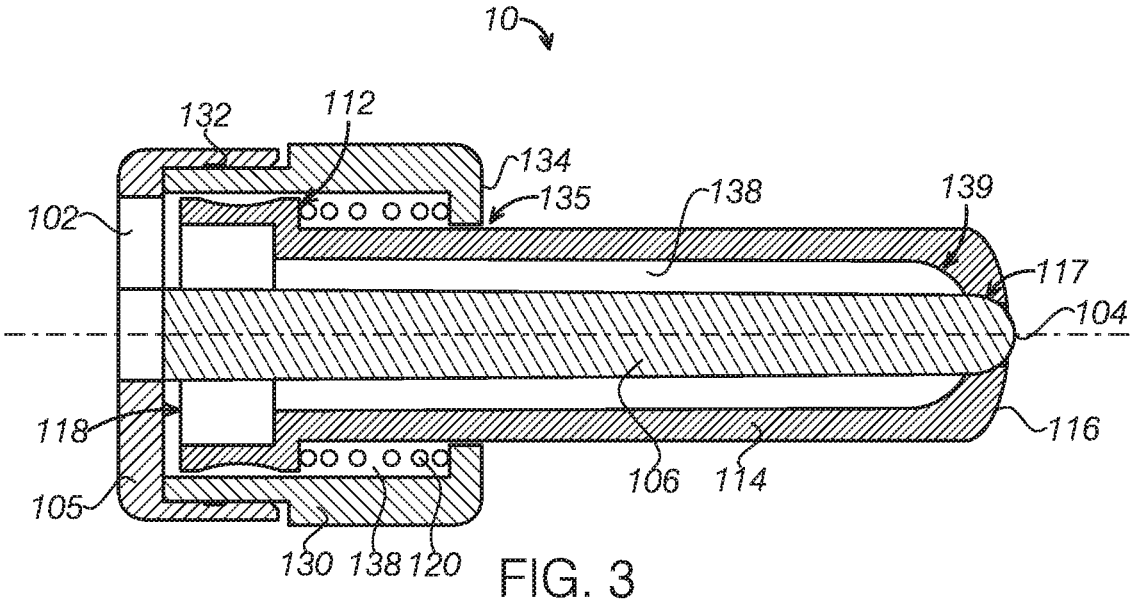
FIG. 3 is a cross sectional view of the nozzle of FIG. 1.

Turning now to FIG. 3, a cross sectional view of nozzle 10 is shown. As can be seen, first bearing surface 111 of shoulder 113 may interface with an interior surface of sleeve 130, i.e., second bearing surface 136. As noted above, first bearing surface 111 and second bearing surface 136 may together form a first liquid seal. In some embodiments, the first liquid seal may be a primary seal. In the illustrated embodiment, shoulder 113 includes a third bearing surface 112, which as noted above, may form a second liquid seal in conjunction with second bearing surface 136. Thus, in some embodiments, the second liquid seal may be a back-up seal. In other embodiments (not pictured), shoulder 113 may be free of third bearing surface 112, and thus there may be only a single seal between nozzle body 110 and sleeve 130.

Still referring to FIG. 3, sleeve 130 may include a retaining lip 134 formed at a distal end of the sleeve 130. The retaining lip 134 may be configured to retain spring 120 and shoulder 113 while allowing the hollow cylinder 114 to extend therethrough. In this regard, retaining lip 134 may form a hole 135, sized to allow hollow cylinder 114 to pass through, yet retaining the spring 120 and shoulder 113.

As can be seen, an annular space 133 may be formed between bearing surface 136 and the outer surface of hollow cylinder 114. The inner surface of retaining lip 134 may define a distal end of annular space 133. The edge of shoulder 113 may define a proximal end of annular space 133. As can be seen, spring 120 is captured within the annular space. Spring 120 may act to push the edge of shoulder 113 away from retaining lip 134. In this regard, spring 120 may bias distal tip 104 of the pillar 106 into contact with the orifice 117.

Still referring to FIG. 3, in the illustrated embodiment, the orifice 117 may have a generally frustoconical shape. In other embodiments, the orifice may have a parabolic shape. In still other embodiments, the orifice may have a hemispherical shape. The distal tip 104 may be contoured to mate with the shape of the orifice, thereby forming the fourth liquid seal.

As can be seen in FIG. 3, an annular channel 138 may be formed between the inner surface of hollow cylinder 114 and the outer surface of pillar 106. The annular channel 138 may terminate at end wall 139.

In the illustrated embodiment, nozzle body 100, pillar assembly 100, and/or sleeve 130 may comprise one or more plastics. In other embodiments, nozzle body 100, pillar assembly 100, and/or sleeve 130 may comprise metal, ceramic, composites, wood or other suitable materials.

In the illustrated embodiment, spring 120 may comprise steel. In other embodiments, the spring may comprise other metals, plastics, composites or other suitable materials.

Figure 4A:
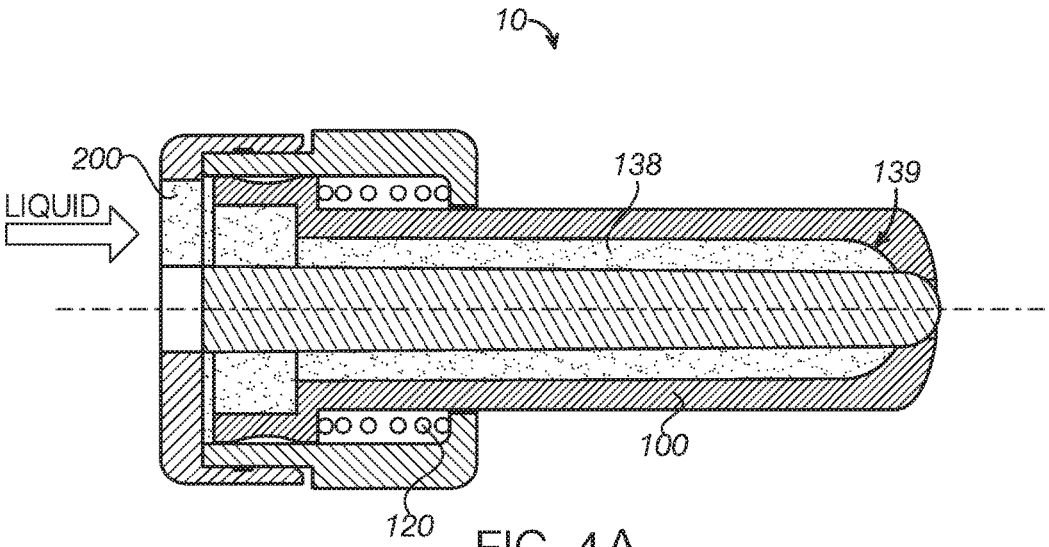
FIGS. 4 A-B are cross sectional views of the nozzle of FIG. 1, showing the nozzle in operation.
Figure 4B:
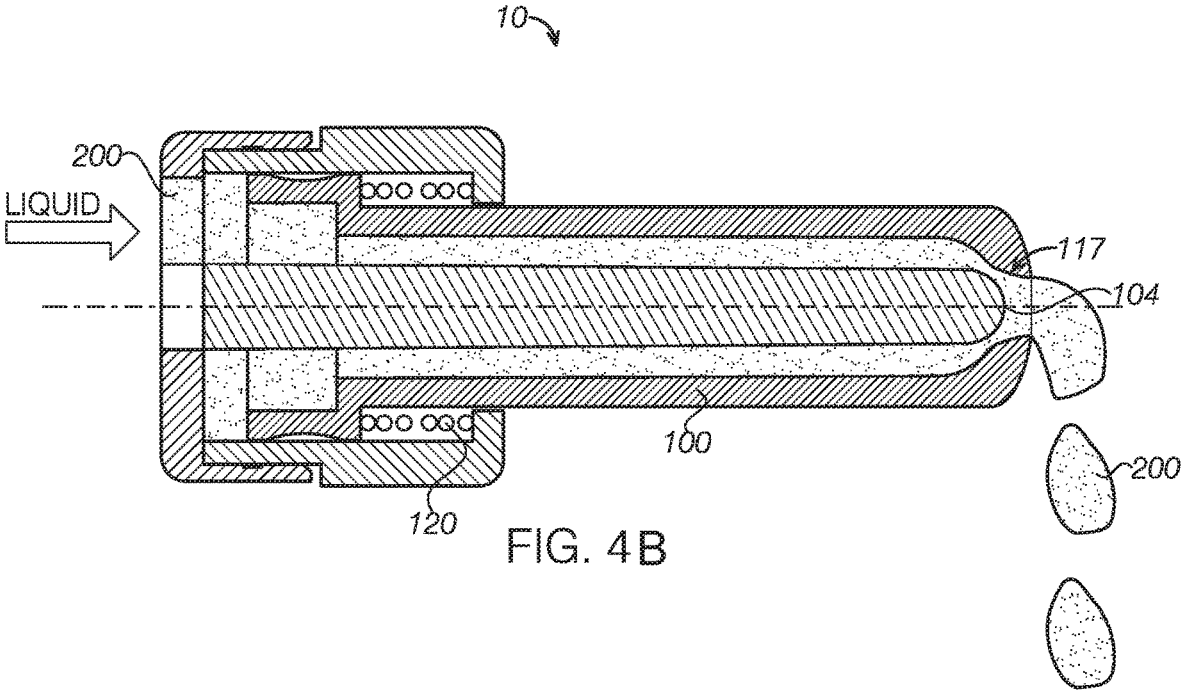

Turning now to FIGS. 4A-B, an illustration of the nozzle 10 in operation is shown. Referring to FIG. 4A, a liquid 200 may enter the nozzle 10 through perforations 102 in end cap 105. Liquid 200 (e.g., liquid product such as makeup, lotion, and food products, among many others) may then flow through annular channel 138 until reaching end wall 139. As pressure in the liquid 200 is increased, that pressure is exerted on end wall 139, counteracting the force of spring 120.

Referring now to FIG. 4B, once the pressure of liquid 200 against end wall 139 overcomes the biasing force of spring 120, the spring 120 may be forced to compress, causing nozzle body 100 to slide forward inside sleeve 130. Is this regard, annular space 133 may contract when nozzle body 100 slides forward relative to sleeve 130.

The forward motion of nozzle body 100 may break the seal between distal tip 104 and orifice 117, thereby allowing liquid 200 to exit from the orifice 117. Once the pressure of the liquid 200 inside the annular channel 138 falls below the biasing force of spring 120, nozzle body 100 is forced to slide back to its initial position. Thus, the liquid seal between distal tip 104 and orifice 117 may be formed again. Thus, nozzle 10 may be a self-sealing nozzle.

The self-sealing feature described above may prevent evaporation and/or oxidation of the product being dispensed. Furthermore, as can be appreciated, the self-sealing feature of nozzle 10 may prevent build-up of dried product around dispensing end 116. In this regard, nozzle 10 may also be self-cleaning.

Figure 5:
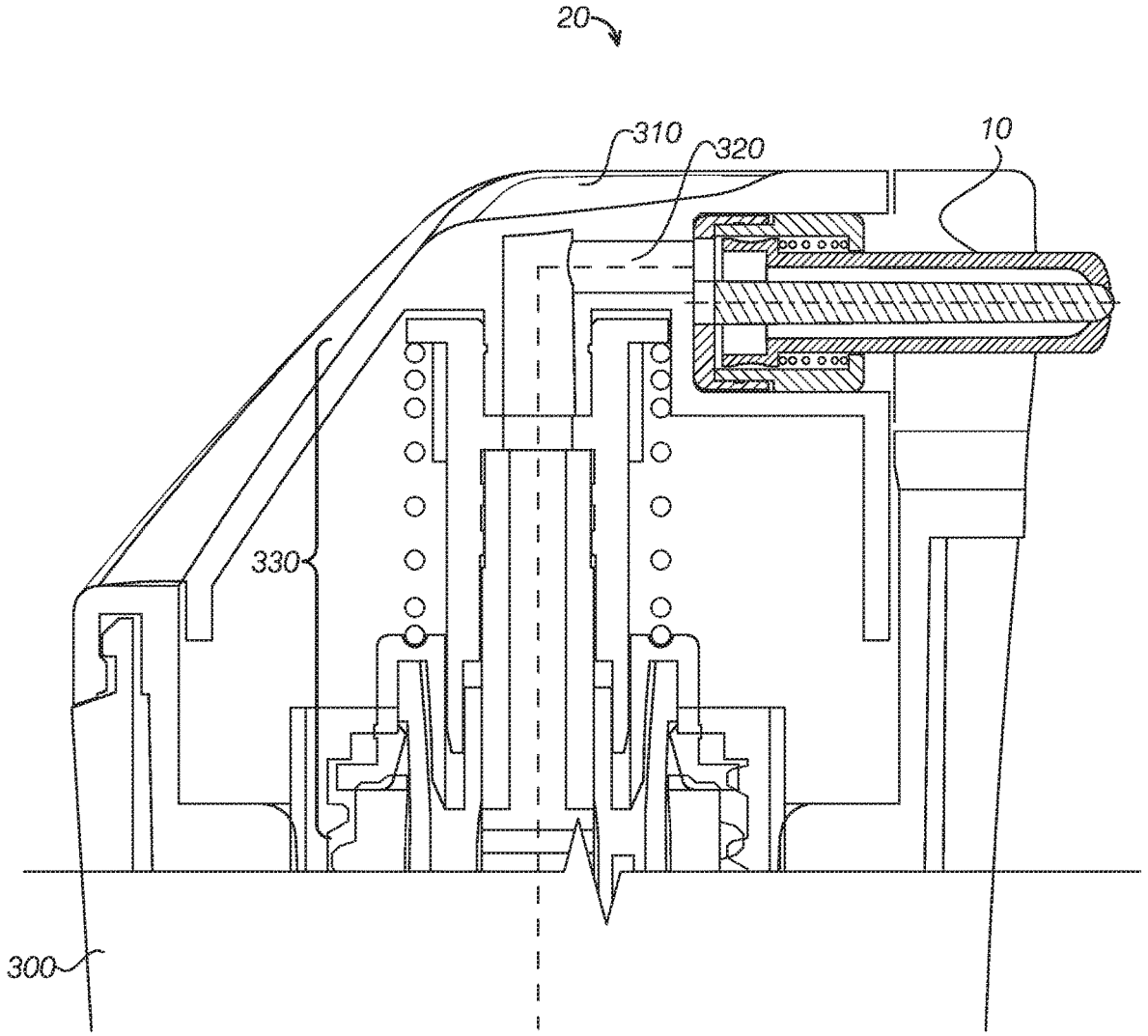
FIG. 5 is a cross sectional view of a liquid dispensing device, including the nozzle of FIG. 1.

Turning now to FIG. 5, a cross sectional view of a liquid dispensing device 20, including nozzle 10 is shown. In the illustrated embodiment, a user may depress pump lever 310 causing pump mechanism 330 to force liquid product through channel 320 and into nozzle 10.

The disclosure above encompasses multiple distinct inventions with independent utility. While each of these inventions has been disclosed in a particular form, the specific embodiments disclosed and illustrated above are not to be considered in a limiting sense as numerous variations are possible. The subject matter of the inventions includes all novel and non-obvious combinations and subcombinations of the various elements, features, functions and/or properties disclosed above and inherent to those skilled in the art pertaining to such inventions. Where the disclosure or subsequently filed claims recite "a" element, "a first" element, or any such equivalent term, the disclosure or claims should be understood to incorporate one or more such elements, neither requiring nor excluding two or more such elements.

Applicant(s) reserves the right to submit claims directed to combinations and subcombinations of the disclosed inventions that are believed to be novel and non-obvious. Inventions embodied in other combinations and subcombinations of features, functions, elements and/or properties may be claimed through amendment of those claims or presentation of new claims in the present application or in a related application. Such amended or new claims, whether they are directed to the same invention or a different invention and whether they are different, broader, narrower or equal in scope to the original claims, are to be considered within the subject matter of the inventions described herein.

The invention claimed is:

1. A self-sealing and self-cleaning nozzle, comprising:

a nozzle body having a hollow cylindrical interior, the nozzle body comprising an orifice formed in a distal end of the nozzle body; wherein an end wall is provided at the distal end of the nozzle body;

a shoulder formed on a proximal end of the nozzle body; and a first bearing surface on an outer lateral face of the shoulder;

a sleeve surrounding the proximal end of the nozzle body, the sleeve including:

a second bearing surface on an inner face of the sleeve;

a retaining lip formed at a distal end of the sleeve;

wherein the retaining lip defines a distal end of an annular space between the sleeve and the nozzle body; and wherein the shoulder defines a proximal end of the annular space;

a pillar disposed within the hollow interior of the nozzle body;

wherein the pillar has a distal tip configured to interface with the orifice at the end wall at the distal end of the nozzle body and extending beyond the orifice, thereby forming a liquid seal;

a spring captured within the annular space, thereby biasing the distal tip of the pillar into contact with the orifice; wherein the spring is moveable between an extended position and a retracted position and depending upon amount of pressure from a nozzle body bearing surface, the nozzle body is slidable forward towards the distal end of the nozzle body to thereby break the liquid seal of the orifice at the end wall of the distal end of the nozzle body and is slidable in the opposite direction of the end wall of the distal end of the nozzle body upon the spring being returned to the extended position to thereby reform the liquid seal at the end wall; and a third bearing surface on the outer lateral face of the shoulder, wherein the first and second bearing surfaces form a first liquid seal by direct interface of the first and second bearing surfaces with each other, and wherein the third and second bearing surfaces form a second liquid seal by direct interface of the third and second bearing surfaces with each other.

2. The nozzle of claim 1, wherein the orifice has a frustoconical shape.

3. The nozzle of claim 2, wherein the distal tip of the pillar is tapered to mate with the frustoconical shape of the orifice.

4. The nozzle of claim 1, comprising:

an end cap secured on a proximal end of the sleeve, thereby retaining the proximal end of the nozzle body.

5. The nozzle of claim 4, wherein a proximal end of the pillar is attached to the end cap via a perforated plate.

6. The nozzle of claim 1, wherein the first and second bearing surfaces form a liquid seal by direct interface of the first and second bearing surfaces with each other.

7. A liquid dispensing device comprising:

a pump lever;

a pump mechanism configured to be actuated via the pump lever, and a self-sealing and self-cleaning nozzle, the nozzle comprising:

a nozzle body having a hollow cylindrical interior, the nozzle body comprising: an orifice formed in a distal end of the nozzle body;

wherein an end wall is provided at the distal end of the nozzle body;

wherein the pump mechanism is located at a proximal end of the nozzle body for forcing liquid though the hollow cylindrical interior into the nozzle;

a shoulder formed on a proximal end of the nozzle body; and a first bearing surface on an outer lateral face of the shoulder, a sleeve surrounding the proximal end of the nozzle body, the sleeve including: a second bearing surface on an inner face of the sleeve; a retaining lip formed at a distal end of the sleeve;

wherein the retaining lip defines a distal end of an annular space between the sleeve and the nozzle body; and wherein the shoulder defines a proximal end of the annular space; a pillar disposed within the hollow interior of the nozzle body;

wherein the pillar has a distal tip configured to interface with the orifice at the end wall at the distal end of the nozzle body and extending beyond the orifice, thereby forming a liquid seal; and a spring captured within the annular space, thereby biasing the distal tip of the pillar into contact with the orifice;

wherein the spring is moveable between an extended position and a retracted position and depending upon amount of pressure from a nozzle body bearing surface, the nozzle body is slidable forward towards the distal end of the nozzle body to thereby break the liquid seal of the orifice at the end wall of the distal end of the nozzle body and is slidable in the opposite direction of the end wall of the distal end of the nozzle body upon the spring being returned to the extended position to thereby reform the liquid seal at the end wall; and a third bearing surface on the outer lateral face of the shoulder, wherein the first and second bearing surfaces form a first liquid seal by direct interface of the first and second bearing surfaces with each other, and wherein the third and second bearing surfaces form a second liquid seal by direct interface of the third and second bearing surfaces with each other.

8. The nozzle of claim 7, wherein the orifice has a frustoconical shape.

9. The nozzle of claim 8, wherein the distal tip of the pillar is tapered to mate with the frustoconical shape of the orifice.

10. The nozzle of claim 7, comprising:

an end cap secured on a proximal end of the sleeve, thereby retaining the proximal end of the nozzle body.

11. The nozzle of claim 10, wherein a proximal end of the pillar is attached to the end cap via a perforated plate.

12. The nozzle of claim 7, wherein the first and second bearing surfaces form a liquid seal by direct interface of the first and second bearing surfaces with each other.

* * * * *